United States Patent [19]

Hall

[11] Patent Number: 4,481,682

[45] Date of Patent: Nov. 13, 1984

[54] SUSPENDERS

[76] Inventor: Bradley G. Hall, 2395 Cawthra Rd., Unit 13, Mississauga, Canada

[21] Appl. No.: 479,819

[22] Filed: Mar. 28, 1983

[51] Int. Cl.[3] ..... A41F 3/00; A41F 19/00

[52] U.S. Cl. ..... 2/326; 2/304; 2/DIG. 6

[58] Field of Search ..... 2/326, 304, 305, 307, 2/308, 310, DIG. 6

[56] References Cited

U.S. PATENT DOCUMENTS

| | | | |
|---|---|---|---|
| 257,485 | 5/1882 | Foote | 2/305 |
| 1,392,935 | 10/1921 | Glickman | 2/326 |
| 2,436,581 | 2/1948 | Lazare | 2/305 |
| 2,440,982 | 5/1948 | Speller et al. | 2/305 |
| 3,480,275 | 11/1969 | Jernstrom | 2/308 X |
| 3,501,774 | 3/1970 | Norman | 2/DIG. 6 X |
| 4,213,548 | 7/1980 | Wood | 2/DIG. 6 X |

FOREIGN PATENT DOCUMENTS

| | | | |
|---|---|---|---|
| 136249 | 1/1934 | Austria | 2/308 |
| 612702 | 5/1935 | Fed. Rep. of Germany | 2/326 |
| 844824 | 5/1939 | France | 2/326 |
| 2050810 | 1/1981 | United Kingdom | 2/DIG. 6 |

*Primary Examiner*—H. Hampton Hunter

[57] ABSTRACT

Suspenders for pants or trousers have two front and one rear connector with strap apertures, a strap designed to pass through one front connector aperture over the shoulder of a wearer, through the rear connector aperture, over the other shoulder and through the front connector apertures. The strap near each end has hook and eye fastener material so that the strap may be fastened in a loop. A junction member is provided attaching to the rear extents of the strap by hook and eye material.

15 Claims, 2 Drawing Figures

SUSPENDERS

Figure 1:
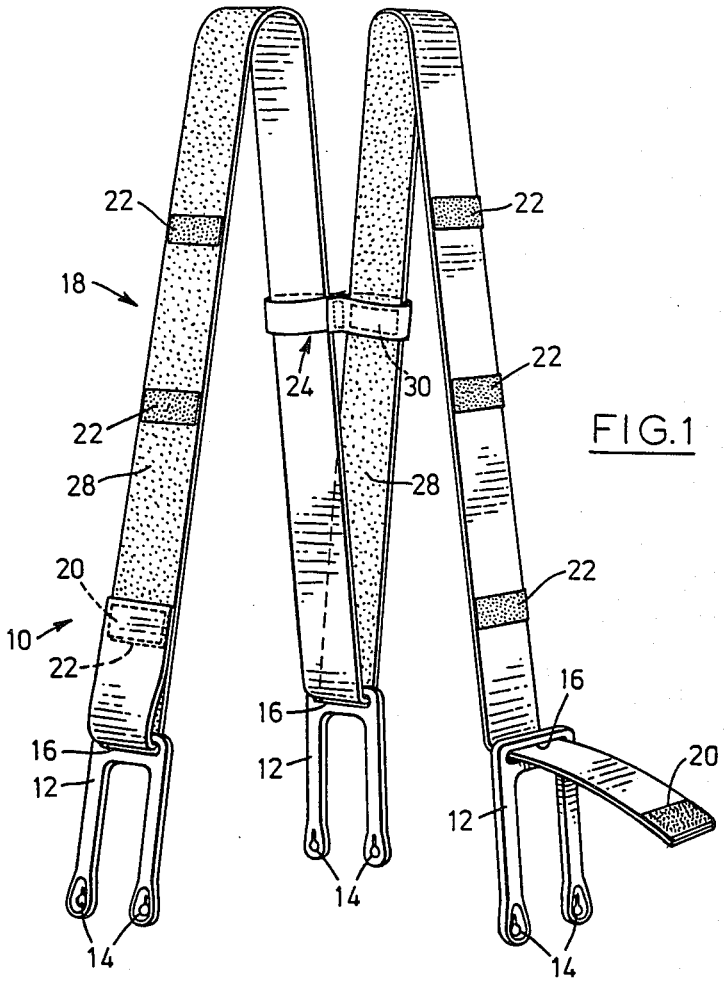

This invention relates to a novel design for suspenders to support trousers or pants on the wearer's body. Although the primary use of the inventive suspenders is thought to be in the field of sports clothing, e.g. for holding up hockey pants, the invention is useful with conventional clothing also.

By 'hook and loop fastening material' herein is meant the two cooperating types of material well known when sold under the trade mark "VELCRO" and sold by Velcro Canada Limited, 114 East Drive, Bramalea, Ontario, Canada.

Conventional suspenders require metallic or plastic buckles for adjustment of each of the front straps and for adjustment of a junction member at the point at the back where two strap extents diverge from each other to go forwardly over each shoulder.

This invention provides suspenders with fastening and adjustment means using hook and loop fastening techniques, to replace the requirement for metallic and plastic buckles at the front and for the junction member at the back. There are thus provided suspenders having all the utility and adjustability of conventional suspenders but which are more comfortable and convenient.

The invention is used with two front connectors and a rear connector. The connector is designed to have means for connection to pants and trousers and an aperture (preferably a slot) for connection to the strap of the suspenders. The strap is designed to extend through the apertures of one front connector, the rear connector and the other front connector. Adjacent each end of the strap there is provided an exposed portion of one type of the hook and loop material and at a location on the strap near each end is provided a corresponding exposed portion of the other type of hook and loop material. With the end of the strap through the aperture in the front connector, the corresponding hook and loop portions may be mutually attached to connect to the connector. The mutually attached portions will be arranged so that such attachment takes place at the front of the wearer's body. The extent of one of the mutually attachable portions of hook or loop material determines the range of adjustability of the suspenders. That part of the strap which will be worn at the back of the wearer is provided, on each rear extent leading from the rear connector with a surface for attachment to a junction member. A junction member, preferably a double loop member is designed to attach to each rear extent surface in the same manner as the hook and loop attachments. It is preferred, for economy, to replace the loop material by the nap of strap material. (Such replacement is possible with the lesser stresses on the rear junction member although not at the front of the suspenders where the full strength of a hook and loop attachment is required). It follows that the junction preferably double loop member, may be detached and attached from the strap extents to be located at the rear of the wearer and raised and lowered to control the point of divergence of the two strap extents which will go over opposite shoulders of the wearer.

Figure 2:
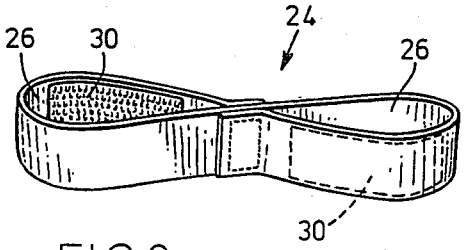

In drawings which illustrate a preferred embodiment of the invention:

FIG. 1 is a perspective view of suspenders in accord with the invention; and FIG. 2 is a view, enlarged relative to FIG. 1, of a preferred form of the junction member.

In the drawings are shown three connectors for connecting the strap to the pants or trousers. Each of the front connectors and the rear connector has two tines 12 defining button holes 14 at their extremities, extending from a body having an aperture, here a slot 16 to receive a strap. The connectors are preferably made of plastic but may be made of leather or other material. The button hole forming portions represent only one of a number of alternatives methods for attaching the connectors 10 to the pants or trousers.

A strap or band 18 is of a length to extend through the respective slot 16 of one front connector, the slot 16 of the rear connector and the slot 16 of the other front connector. The strap 18 is preferably made of a single integral band. Although it could, within the scope of the invention, be made from attached lengths; however, this would detract from the simplicity and the economy of the construction. The strap 18, or at least portions thereof, are preferably made resiliently stretchable in the longitudinal direction.

For the front adjustment of the suspenders the strap 18 is provided immediately adjacent each end with an attached (here sewn-on) portion 20 of one of the types of hook and loop fastening material, here the hook type is used. Spaced from each end of the strap, but arranged to be located at the front of the wearer's body when in use, are a plurality of longitudinally spaced sewn-on pads 22 of the other type of hook and loop fastening material, here loop, material. Thus the adjustment of the front lengths of the suspenders is achieved by attaching end pad 20 to a selected one of the corresponding pads 22 after passage through the connector slot. It will be appreciated that the plural spaced corresponding pads 22 could be replaced by a single strip of the same hook or loop type material giving an even finer range of adjustment. However, this is a considerably more expensive arrangement and the spaced pads 22 have been found to provide adequate adjustment.

The other adjustment for the suspenders is the control of that location where the strap lengths running up the wearer's back diverge to go over opposite shoulders. A double loop member 24, preferably a piece of band sewn into its double loop form, is designed to receive in its respective loops 26, respective extents of strap 18 extending from the rear connector. Thus the strap extents at the rear of the suspenders when worn will be side-by-side and slightly diverging, as shown, from the rear connector to the double loop member 26 and will then diverge to go over opposite shoulders. The inside of the loops 26 at proper locations are provided with portions of one type of hook and loop fastening material. The strap extents from the rear connectors may be provided with portions (or an extended portion) of the other type of hook and loop fastening material, whereby the height of the double loop member may be adjusted by raising or lowering the double loop member and attaching to the hook and loop material of each rear extent at the desired location. It will be noted that, for the rear adjustments, if the hook or loop portions on the rear lengths are on the same side of the strap when extended flat, then the material in the two loop members will face opposite ways.

In some case, and as shown in the preferred embodiments, a saving of the hook and loop fastening material may be achieved. The resiliently stretchable strap material may be purchased to have a nap or pile (often known in the trade as "plush") on one or both sides. The strap 18 shown has the nap on the surface 28 only. It is found that for the purposes of the loop adjuster this nap is sufficient to attach to the hook and loop fastening material of the hook type. Thus the double loop member may be provided with hook material 30 facing opposite directions to attach to the nap of side 28 at the desired height (and it may be detached and readjusted), and the strap will thus not require pads of corresponding loop material. However, it should be noted that the stresses on the hook-loop or hook-nap attachment at the rear are much less at the double loop connector than at the front strap adjustments. Thus, although the nap may usually be substituted for the loop material at the rear junction member, it will not be adequate to replace the loop material at the front adjustments.

A strap having nap on one side, longitudinally stretchable and having the desired qualities for use at the rear junction member can be purchased from Britex Ltd, P.O. Box 460, Bridgetown, N.S.

I claim:

1. Suspenders for pants or trousers comprising:

a connector for attachment to the rear of a garment, a pair of connectors for attachment to the front of a garment, an aperture in each garment connector, a strap designed to pass through one front connector, aperture, over the shoulder of a wearer, through the rear connector aperture, over the other shoulder and through the other front connector aperture, said strap having adjacent each end at least one first exposed portion of material of one type of the hook or loop of hook and loop fastener material, said strap having, near each end and spaced from said one exposed portion, at least one corresponding second exposed portion of material of the other type of the hook and loop fastener material, whereby the strap may be attached to each front connector by extending the corresponding end thereof through the connector aperture and pressing the two corresponding portions together, to the corresponding portions being so located that such attachment takes place on strap extents at the front of the wearer, a junction member having two surface portions adapted respectively to contact, surfaces of each of the strap extents which extend between the rear connector and the shoulder of the wearer, one of the mutually contacting surfaces of the junction member and of the rear strap extent being of hook type fastener material and the other of the mutually contacting surfaces being of a type to make pressure attachment to the last mentioned hook type fastener material.

2. Suspenders as claimed in claim 1 wherein said surfaces of each of the rear strap extents provide a range of locations along said rear extents for attachment of said junction member.

3. Suspenders as claimed in claim 1 wherein said junction member is formed in a double loop, one loop enclosing each of said rear strap extents.

4. Suspenders as claimed in claim 2 wherein said junction member is formed in a double loop, one loop enclosing each of said rear strap extents.

5. Suspenders as claimed in claim 1 wherein said junction member is formed in a double loop, one loop enclosing each of said rear strap extents, and the junction member surfaces are formed of hook type material and the surfaces of said rear strap extents being provided by a nap on the strap material.

6. Suspenders as claimed in claim 2 wherein said junction member is formed in a double loop, one loop enclosing each of said rear strap extents, and the junction member surfaces are formed of hook type material and the surfaces or said extents being provided by a nap on the strap material.

7. Suspenders as claimed in claim 1 wherein said strap is a single integral length of material having said hook and loop fastening material attached thereto.

8. Suspenders as claimed in claim 2 wherein said strap is a single integral length of material having said hook and loop fastening material attached thereto.

9. Suspenders as claimed in claim 3 wherein said strap is a single integral length of material having said hook and loop fastening material attached thereto.

10. Suspenders as claimed in claim 4 wherein said strap is a single integral length of material having said hook and loop fastening material attached thereto.

11. Suspenders as claimed in claim 1 wherein exposed portions of material of one type are arranged to provide a range of attachment locations along the strap for attachment by exposed portions of material of the other type.

12. Suspenders as claimed in claim 2 wherein exposed portions of material of one type are arranged to provide a range of attachment locations along the strap for attachment by exposed portions of material of the other type.

13. Suspenders as claimed in claim 3 wherein exposed portions of material of one type are arranged to provide a range of attachment locations along the strap for attachment by exposed portions of material of the other type.

14. Suspenders as claimed in claim 4 wherein exposed portions of material of one type are arranged to provide a range of attachment locations along the strap for attachment by exposed portions of material of the other type.

15. Suspenders as claimed in any one of claims 1–14 wherein said strap is of material resiliently stretchable in a longitudinal direction.

* * * * *